US011094259B2

(12) United States Patent
Kim et al.

(10) Patent No.: US 11,094,259 B2
(45) Date of Patent: Aug. 17, 2021

(54) DISPLAY DEVICE AND DRIVING METHOD OF THE SAME

(71) Applicant: Samsung Display Co., Ltd., Yongin-si (KR)

(72) Inventors: Hun-Bae Kim, Asan-si (KR); Hyun-Suk Kang, Asan-si (KR); Jihoon Kim, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/388,785

(22) Filed: Apr. 18, 2019

(65) Prior Publication Data

US 2019/0362675 A1 Nov. 28, 2019

(30) Foreign Application Priority Data

May 23, 2018 (KR) ..... 10-2018-0058664

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2330/021* (2013.01); *G09G 2330/028* (2013.01)

(58) Field of Classification Search
None
See application file for complete search history.

(56) References Cited

U.S. PATENT DOCUMENTS

2011/0084954 A1* 4/2011 Lee ..... G09G 3/3225 345/212
2011/0187697 A1* 8/2011 Yun ..... G09G 3/30 345/212
2013/0321485 A1* 12/2013 Eom ..... G09G 3/3233 345/690
2015/0091950 A1* 4/2015 Park ..... G09G 3/3291 345/690
2016/0133223 A1* 5/2016 Kim ..... G09G 3/20 345/211
2017/0039955 A1* 2/2017 Park ..... G09G 3/3233
(Continued)

FOREIGN PATENT DOCUMENTS

KR 10-0805547 B1 2/2008
KR 10-2015-0038862 A 4/2015
(Continued)

*Primary Examiner* — Patrick N Edouard
*Assistant Examiner* — Peijie Shen
(74) *Attorney, Agent, or Firm* — Lewis Roca Rothgerber Christie LLP

(57) ABSTRACT

A display device includes a display panel includes a plurality of pixels driven by a first power voltage and a second power voltage. A display panel driving circuit is configured to receive image data from an external device, output a first voltage control signal for generating an analog supply voltage based on an on-pixel ratio (OPR) of the image data, and output a second voltage control signal for generating the first power voltage and the second power voltage. A DC-DC conversion circuit is configured to generate the analog supply voltage based on the first voltage control signal and generate the first power voltage and the second power voltage based on the second voltage control signal.

20 Claims, 7 Drawing Sheets

(56) References Cited

U.S. PATENT DOCUMENTS

| | | | | |
|---|---|---|---|---|
| 2017/0092189 | A1* | 3/2017 | Hwang | G09G 3/3233 |
| 2017/0103707 | A1* | 4/2017 | Park | G09G 3/2003 |
| 2017/0124958 | A1* | 5/2017 | Pyo | G09G 3/3291 |
| 2018/0300526 | A1* | 10/2018 | Cho | G06F 3/0412 |
| 2019/0130831 | A1* | 5/2019 | Tan | H03K 3/02 |
| 2019/0279563 | A1* | 9/2019 | Hwang | G09G 3/3233 |

FOREIGN PATENT DOCUMENTS

| | | | |
|---|---|---|---|
| KR | 10-2017-0043719 | A | 4/2017 |
| KR | 10-2018-0021358 | A | 3/2018 |

* cited by examiner

DISPLAY DEVICE AND DRIVING METHOD OF THE SAME

CROSS-REFERENCE TO RELATED APPLICATION

This application claims priority to and the benefit of Korean Patent Application No. 10-2018-0058664, filed on May 23, 2018 in the Korean Intellectual Property Office (KIPO), the contents of which are incorporated herein in its entirety by reference.

BACKGROUND

1. Field

Example embodiments relate generally to a display device and a driving method of the same.

2. Description of the Related Art

Flat panel display (FPD) devices are widely used as display devices for electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. The OLED devices have been spotlighted as next-generation display devices because the OLED devices have various features such as a wide viewing angle, a rapid response speed, a thin thickness, low power consumption, etc.

The display device may display various images and information for an electronic device (e.g., a smartphone, a tablet PC, laptop etc.). Power consumption of the electronic device may increase when performing various functions. Thus, a method for decreasing the power consumption of the electronic device has been studied.

SUMMARY

Some example embodiments provide a display device capable of decreasing power consumption.

Some example embodiments provide a driving method of a display device capable of decreasing power consumption.

According to an aspect of example embodiments, a display device may include a display panel having a plurality of pixels driven by a first power voltage and a second power voltage, a display panel driving circuit configured to receive an image data from an external device, output a first voltage control signal for generating an analog supply voltage based on an on-pixel ratio (OPR) of the image data, and output a second voltage control signal for generating the first power voltage and the second power voltage, and a DC-DC conversion circuit configured to generate the analog supply voltage based on the first voltage control signal and generate the first power voltage and the second power voltage based on the second voltage control signal. A number of pulses in the first voltage control signal is controlled based on the on-pixel ratio, and a voltage level of the analog supply voltage is changed based on the pulse number of the first voltage control signal.

In example embodiments, the display panel driving circuit may include a data processor configured to generate a data signal corresponding to the image data based on the analog supply voltage and a voltage controller configured to generate the first voltage control signal and the second voltage control signal.

In example embodiments, the voltage controller may include a first control signal generator configured to calculate the on-pixel ratio of the image data and generate a first control signal corresponding to the on-pixel ratio, a second control signal generator configured to output a second control signal corresponding to the analog supply voltage having a predetermined voltage level, a first voltage control signal generator configured to generate the first voltage control signal based on the first control signal and the second control signal, and a second voltage control signal generator configured to generate the second voltage control signal.

In example embodiments, the voltage controller may further include a switch unit formed between the on-pixel ratio calculator and the first voltage control signal generator. The first voltage control signal generator may generate the first voltage control signal based on the first control signal and the second control signal when the switch unit is turned on. The first voltage control signal generator may output the second control signal as the first voltage control signal when the switch unit is turned off.

In example embodiments, the first voltage control signal generator may control the number of pulses in the second control signal based on the first control signal and output the modified second control as the first voltage control signal.

In example embodiments, the voltage controller may further include a third control signal generator configured to calculate an AMOLED off ratio (AOR) of the image data and generate a third control signal corresponding to the AMOLED off ratio.

In example embodiments, the first control signal generator may generate the first voltage control signal based on the first control signal, the second control signal, and the third control signal.

In example embodiments, a voltage level of the analog supply voltage may decrease as the on-pixel ratio decreases.

In example embodiments, the display device may change a voltage level of the analog supply voltage in a standby mode in which a standby image is always displayed on the display panel.

In example embodiments, the display device may change a voltage level of the analog supply voltage in a normal mode in which an image is displayed on the display panel.

In example embodiments, the DC-DC converting circuit may include an analog supply voltage generator configured to generate the analog supply voltage provided to the display panel driving circuit based on the first voltage control signal and a power voltage generator configured to generate the first power voltage and the second power voltage based on the second voltage control signal.

In example embodiments, the analog supply voltage generator may generate the analog supply voltage based on the number of pulses in the first voltage control signal.

According to an aspect of example embodiments, a driving method of a display device may include an operation of receiving image data from an external device and calculating an on-pixel ratio (OPR) of the image data, an operation of controlling a pulse number of a first voltage control signal for generating an analog supply voltage based on the on-pixel ratio, an operation of outputting a second voltage control signal for generating a first power voltage and a second power voltage, an operation of generating the analog supply voltage based on the first voltage control signal, and an operation of generating the first power voltage and the second power voltage based on the second voltage control signal.

In example embodiments, the first voltage control signal may be generated based on a first control signal corresponding to the on-pixel ratio of the image data and a second control signal corresponding to the analog supply voltage having a predetermined voltage level.

In example embodiments, the number of pulses in the second control signal may be controlled based on the first control signal and the second control signal may be output as the first voltage control signal.

In example embodiments, the operation of generating the first voltage control signal may further include an operation of generating a third control signal corresponding to an AMOLED off ratio (AOR) of the image data.

In example embodiments, the first voltage control signal may be generated based on the first control signal, the second control signal, and the third control signal.

In example embodiments, the number of pulses in the second control signal may be controlled based on the first control signal and the third control signal and the second control signal of which the pulse number is controlled may be output as the first voltage control signal.

In example embodiments, a voltage level of the analog supply voltage may decrease as the on-pixel ratio decreases.

In example embodiments, a voltage level of the analog supply voltage may be controlled based on the number of pulses in the first voltage control signal.

Therefore, the display device and the driving method of the display device may decrease power consumption of the display device by controlling the voltage level of the analog supply voltage based on the on-pixel ratio of the image data. The display device and the driving method of the display device may decrease power consumption of the display device by controlling the voltage level of the analog supply voltage based on the on-pixel ratio of the image data in the AOD (always on display) mode.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
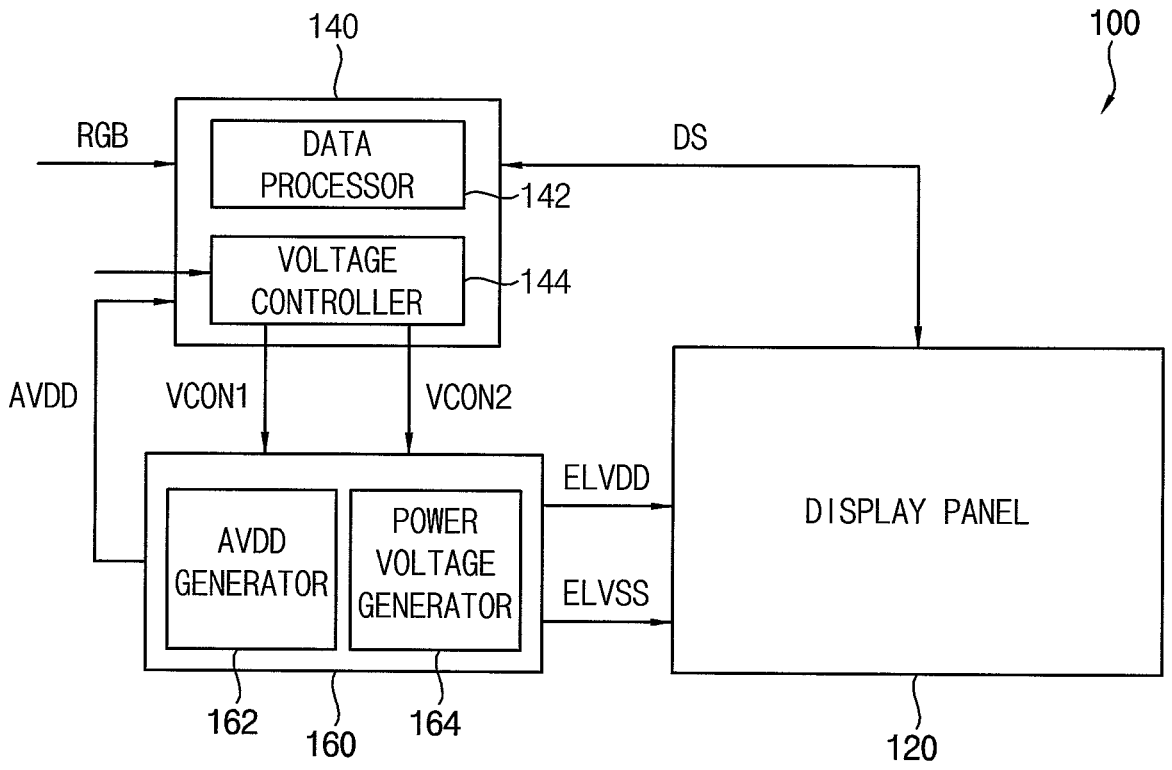
FIG. 1 is a block diagram illustrating a display device according to example embodiments.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g., an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to example embodiments.

Referring to FIG. 1, a display device 100 may have a display panel 120, a display panel driving circuit 140, and a DC-DC conversion circuit 160.

Generally, the display device may have an analog supply voltage of which voltage levels are different in a normal mode than in an always on display (AOD) mode. During the normal mode, an image is received from an external device and is displayed on the display panel. During the AOD mode, a standby image is displayed on the display panel. In various embodiments, the voltage level of the analog supply voltage in the AOD mode may be lower than the voltage level of the analog supply voltage in the normal mode because less information may be displayed during the AOD mode. For example, in various embodiments, information such as time, date, a remaining battery charge, etc. may be displayed on the display panel during the AOD mode. Thus, due to the lower voltage level, the power consumption of the display device may decrease during the AOD mode when compared to display devices where the voltage level of the analog supply voltage is fixed in the normal mode and the AOD mode. In various embodiments, the display device 100 may decrease the power consumption by calculating an on-pixel ratio (OPR) of the image data and controlling the analog supply voltage (AVDD) based on the on-pixel ratio in the normal mode and the AOD mode. Hereinafter, the display device 100, according to example embodiments, will be described in detail.

In various embodiments, the display panel 120 may include a plurality of pixels. Additionally, a plurality of data lines and a plurality of scan lines may be formed in the display panel 120. In various embodiments, the data lines may extend in a first direction and be arranged in a second direction perpendicular to the first direction. Similarly, the scan lines may extend in the second direction and be arranged in the first direction. For example, the first direction may be parallel with a short side of the display panel 120, and the second direction may be parallel with a long side of the display panel 120. Each of the pixels may be formed at a crossing region of the data line and the scan line. In various embodiments, the display panel 120 may further include a plurality of first power voltage providing lines and a plurality of second power voltage providing lines. The first power voltage providing line and the second power voltage providing line may be arranged in the first direction or the second direction. Alternatively, the first power voltage providing line and the second power voltage providing line may be arranged in a mesh structure. In example embodiments, each of the pixels may include a switching transistor electrically coupled to the data line and the scan line, a driving transistor coupled to the switching transistor, and a capacitor coupled to the switching transistor. Here, the display panel 120 may be an organic light emitting display (OLED) panel 120 and the display device 100 may be an organic light emitting device 100. Each of the pixels may be driven by a first power voltage ELVDD and a second power voltage ELVSS. Each of the pixels may emit light according to a data signal DS provided in response to a scan signal.

In various embodiments, the display panel driving circuit 140 may receive image data RGB from an external device, output a first voltage control signal VCON1 for generating an analog supply voltage AVDD and a second voltage control signal VCON2 for generating second power voltage ELVSS. In various embodiments, the display panel driving circuit 140 is configured to output the first voltage control signal VCON1 for generating an analog supply voltage AVDD based on an on-pixel ratio (OPR) of the image data. Alternatively, the display panel driving circuit 140 may output the first voltage control signal VCON1 for generating the analog supply voltage AVDD based on a color on-pixel ratio (COPR) of the image data RGB. The COPR may be the on-pixel ratio that adjusts property value of the display panel related to the image data RGB and an emission.

In various embodiments, the display panel driving circuit 140 may include a data processor 142 and a voltage controller 144.

The data processor 142 may receive the image data RGB from the external device. The image data RGB may include red image data, green image data and blue image data. The data processor 142 may selectively perform a display quality correction, an adaptive color correction (ACC), dynamic capacitance compensation (DCC), and/or other suitable correction. Alternatively, the data processor 142 may not perform any correction on the image data RGB. Further, the data processor 142 may generate gamma voltages based on the analog supply voltage AVDD provided from the DC-DC conversion circuit 160 and output the gamma voltages corresponding to the image data RGB as the data signal DS.

The voltage controller 144 may generate a first voltage control signal VCON1 for generating the analog supply voltage AVDD and a second voltage control signal VCON2 for generating the first power voltage ELVDD and the second power voltage ELVSS. The voltage controller 144 may receive the image data RGB provided from the external device and calculate the on-pixel ratio of the image data RGB. The voltage controller 144 may generate a first control signal corresponding to the on-pixel ratio. The voltage controller 144 may also generate a second control signal corresponding to the analog supply voltage AVDD having a voltage level (e.g., a predetermined voltage level). For example, the voltage level of the analog supply voltage AVDD may be 8.6V when the display device 100 is driven in the normal mode and the voltage level of the analog supply voltage AVDD may be 7.6 when the display device 100 is driven in the AOD mode.

In some example embodiments, the voltage controller 144 may generate the first voltage control signal VCON1 based on a first control signal and a second control signal. In these embodiments, the voltage controller 144 may control the number of pluses in the second control signal based on the first control signal and output the second control signal as the first voltage control signal VCON1. For example, the voltage controller 144 may increase the number of pulses in the second control signal as the on-pixel ratio decreases. In other example embodiments, the voltage controller 144 may calculate an AOR (AMOLED off ratio) of the image data RGB, generate a third control signal corresponding to the AOR, and generate the first voltage control signal VCON1 based on the first control signal, the second control signal, and the third control signal. In this case, the voltage controller may govern the number of pulses in the second control signal based on the first control signal and the third control signal, and output the modified second control signal as the first voltage control signal VCON1. For example, the voltage controller 144 may increase the number of pulses in the second control signal as the on-pixel ratio decreases and increase the number of pulses in the second control signal as the AOR increases.

Further, the voltage controller 144 may generate the second voltage control signal VCON2 for generating the first power voltage ELVDD and the second power voltage ELVSS provided to the pixels. The voltage controller 144 may generate respective second voltage control signals VCON2 for generating the first power voltage ELVDD and for generating the second power voltage ELVSS. Alternatively, the voltage controller 144 may generate a single second voltage control signal VCON2 for generating the first power voltage ELVDD and the second power voltage ELVSS. For example, the second voltage control signal VCON2 may include a first pulse period that generates pulses for generating the first power voltage ELVDD and a second pulse period that generates pulses for generating the second power voltage ELVSS. The voltage controller 144 may provide the first voltage control signal VCON1 and the second voltage control signal VCON2 to the DC-DC conversion circuit 160.

The DC-DC conversion circuit 160 may generate the analog supply voltage AVDD based on the first voltage control signal VCON1 and generate the first power voltage ELVDD and the second power voltage ELVSS based on the second voltage control signal VCON2. The DC-DC conversion circuit 160 may be electrically coupled to the display panel driving circuit 140. The DC-DC conversion circuit 160 may receive the first voltage control signal VCON1 and the second voltage control signal VCON2 from the display panel driving circuit 140. For example, the DC-DC conversion circuit 160 may be receive the first voltage control signal VCON1 and the second voltage control signal VCON2 through a single wire (S-WIRE) coupled between the DC-DC conversion circuit 160 and the display panel driving circuit 140.

The DC-DC conversion circuit 160 may include an analog supply voltage generator 162 and a power voltage generator 164.

The analog supply voltage generator 162 may generate the analog supply voltage AVDD provided to the display panel driving circuit 140 based on the first voltage control signal VCON1. The analog supply voltage generator 162 may control the voltage level of the analog supply voltage AVDD based on the number of pulses in the first voltage control signal VCON1. In some example embodiments, the analog supply voltage generator 162 may decrease the voltage level of the analog supply voltage AVDD as the number of pulses in the first voltage control signal VCON1 increases. In other example embodiments, the analog supply voltage generator 162 may determine the voltage level of the analog supply voltage AVDD corresponding to the number of pulses in the first voltage control signal VCON1 using a lookup table (LUT) that includes the voltage levels of the analog supply voltage AVDD corresponding to the number of pulses in the first voltage control signal VCON1. The analog supply voltage AVDD generated in the analog supply voltage generator 162 may be provided to the display panel driving circuit 140.

The DC-DC conversion circuit 160 may generate the first power voltage ELVDD and the second power voltage ELVSS based on the second voltage control signal VCON2. In some example embodiments, the second voltage control signals VCON2 includes multiple signals for generating the first power voltage ELVDD and the second power voltage ELVSS are respectively, and are provided from the voltage controller 144 of the display panel driving circuit 140. In these embodiments, the power voltage generator 164 may generate the first power voltage ELVDD and the second power voltage ELVSS based on each of the second voltage control signals VCON2. In other example embodiments, the second voltage control signal VCON2 includes the first pulse period and the second pulse period for generating the first power voltage ELVDD and the second power voltage ELVSS. In these embodiments, the second voltage control signal VCON2 is provided form the voltage controller 144 of the display panel driving circuit 140 and the power voltage generator 164 may generate the first power voltage ELVDD during the first pulse period and generate the second power voltage ELVSS during the second pulse period. The first power voltage ELVDD and the second power voltage ELVSS generated by the power voltage generator 164 of the DC-DC conversion circuit 160 may be provided to the display panel 120. The first power voltage ELVDD generated in the power voltage generator 164 may be provided to the pixels in the display panel 120 through the first power voltage providing line and the second power voltage ELVSS generated in the power voltage generator 164 may be provided to the pixels in the display panel 120 through the second power voltage providing line.

As described above, the display device 100 according to example embodiments may decrease the power consumption of the display device 100 by controlling the voltage level of the analog supply voltage AVDD based on the on-pixel ratio of the image data RGB. That is, the display device 100, according to example embodiments, may decrease the voltage level of the analog supply voltage AVDD when the on-pixel ratio of the image data RGB decreases, and thereby decreasing the power consumption of the display device 100. When the display device 100 operates in the AOD mode for a long period of time, the display device 100 may significantly reduce power consumption.

Figure 2:
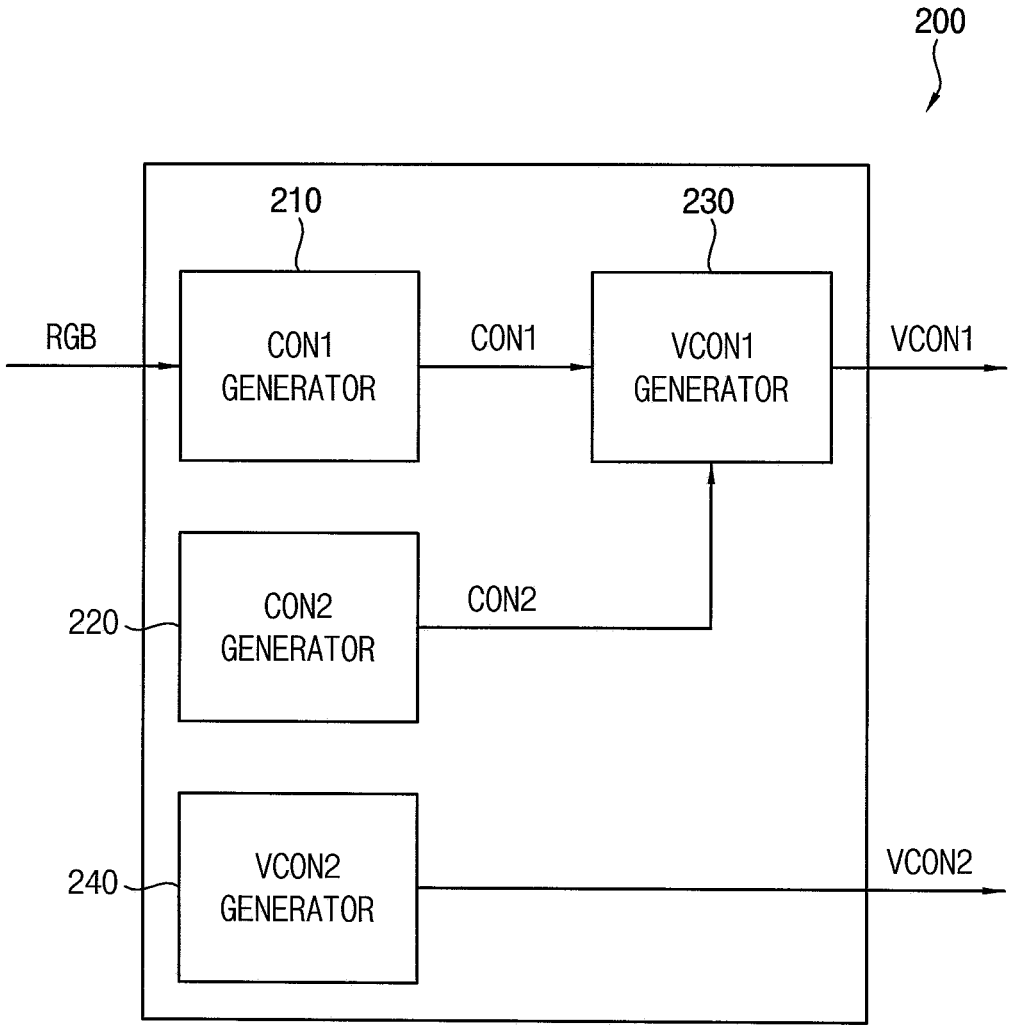
FIG. 2 is a block diagram illustrating an example of a voltage controller included in a driving circuit for a display panel included in the display device of FIG. 1.

FIG. 2 is a block diagram illustrating an example of a voltage controller included in a driving circuit for a display panel included in the display device of FIG. 1.

Referring to FIG. 2, the voltage controller 200 may include a first control signal generator 210, a second control signal generator 220, a first voltage control signal generator 230, and a second voltage control signal generator 240. In various embodiments, the voltage controller 200 of FIG. 2 may correspond to the voltage controller 144 included in the display panel driving circuit 140 of FIG. 1.

In various embodiments, the first control signal generator 210 may calculate the on-pixel ratio of the image data RGB. For example, the first control signal generator 210 may receive the image data RGB and calculate the on-pixel ratio that represents a ratio of all pixels to pixel that are turned on (e.g., turned on according to the image data RGB). Although the first control signal generator 210 that calculates the on-pixel ratio of the image data RGB is described with reference to FIG. 2, an operation of the first control signal generator 210 is not limited thereto. For example, the first control signal generator 210 may calculate the color on-pixel ratio that adjusts the value of the image data RGB and the display panel, and generates the first control signal CON1 based on the color on-pixel ratio. The first control signal generator 210 may generate the first control signal CON1 corresponding to the on-pixel ratio. The first control signal generator 210 may provide the first control signal CON1 to the first voltage control signal generator 230.

The second control signal generator 220 may output the second control signal corresponding to the analog supply voltage having a voltage level (e.g., a predetermined voltage level). For example, the second control signal generator 220 may output the second control signal CON2 corresponding to the analog supply voltage having a first voltage level. The first voltage level in the AOD mode may be lower than the first voltage level in the normal mode.

The first voltage control signal generator 230 may generate the first voltage control signal VCON1 based on the first control signal CON1 and the second control signal CON2. The first voltage control signal generator 230 may control the number of pulses in the second control signal CON2 based on the first control signal CON1. For example, when the image data RGB has a first on-pixel ratio higher than a reference on-pixel ratio (e.g., a predetermined reference on-pixel ratio) and the first control signal generator 210 provide the first control signal CON1 corresponding to the first on-pixel ratio, the first voltage control signal generator 210 may not control the number of pulses in the second control signal CON2 and output the second control signal CON2 as the first voltage control signal VCON1. The DC-DC conversion circuit may generate the analog supply voltage having the first voltage level based on the first voltage control signal VCON1. That is, the first voltage controller 230 may generate a first voltage control signal VCON1 that does not change the voltage level (e.g., the predetermined voltage level) of the analog supply voltage when the display quality is degraded due to the analog supply voltage being too low.

In various embodiments, the image data RGB may have a second on-pixel ratio lower than the reference on-pixel ratio and the first control signal generator 210 provides the first control signal CON1 corresponding to the second on-pixel ratio. The first voltage control signal generator 230 may correspondingly increase the number of pulses in the second control signal CON2 and output the second control signal CON2 as the first voltage control signal VCON1. The DC-DC conversion circuit may therefore generate the analog supply voltage having a second voltage level based on the first voltage control signal VCON1. That is, when the on-pixel ratio of the image data RGB is lower than the predetermined reference on-pixel ratio, the first voltage control signal generator 230 may generate a first voltage control signal VCON1 that decreases the voltage level of the analog supply voltage.

The second voltage control signal generator 240 may generate the second voltage control signal VCON2. In some example embodiments, the second voltage control signal 240 may generate the second voltage control signals VCON2 for generating the first power voltage and second power voltage. In other example embodiments, the second voltage control signal generator 240 may generate the second voltage control signal VCON2 for generating the first power voltage and second power voltage. In this case, the second voltage control signal VCON2 may have the first pulse period during which the pulses for generating the first power voltage and the second pulse period during which the pulses for generating the second power voltage. The DC-DC convert circuit may generate the first power voltage and the second power voltage based on the second voltage control signal VCON2.

As described above, the display device may decrease the power consumption of the display device by generating the first voltage control signal VCON1 based on the on-pixel ratio of the image data RGB and controlling the voltage level of the analog supply voltage based on the first voltage control signal VCON1.

Figure 3:
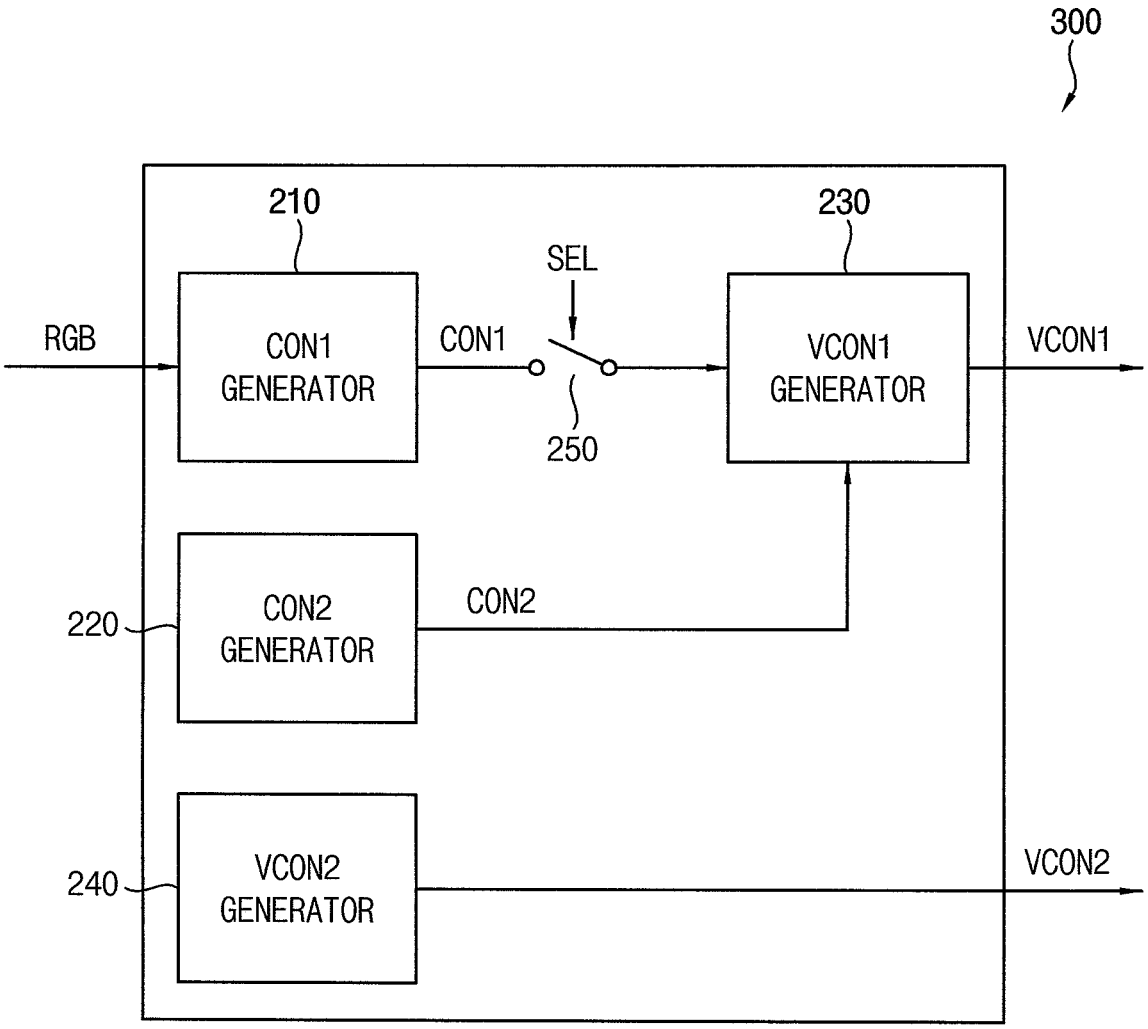
FIG. 3 is a block diagram illustrating another example of a voltage controller included in a driving circuit for a display panel included in the display device of FIG. 1.

FIG. 3 is a block diagram illustrating another example of a voltage controller included in a driving circuit for a display panel included in the display device of FIG. 1.

Referring to FIG. 1, the voltage controller 200 may include a first control signal generator 210, a second control signal generator 220, a first voltage control signal generator 230, a second voltage control signal generator 240, and a switch unit 250. The voltage controller 300 of FIG. 3 may correspond to the voltage controller 144 included in the display panel driving circuit 140 of FIG. 1. The voltage controller 300 may be substantially the same as the voltage controller 144 of FIG. 1 except that the voltage controller 300 includes the switch unit 250.

The switch unit 250 may be arranged between the first control signal generator 210 and the first voltage control signal generator 230. The first control signal CON1 output from the first control signal generator 210 may be provided to the first voltage control signal generator 230 when the switch unit 250 is turned on. The first control signal generator 210 may control the number of pulses in the second control signal CON2 provided from the second control signal generator 220 based on the first control signal CON1 and output the modified second control signal CON2 (e.g., modified with the number of pulses) as the first voltage control signal VCON1. The output from the first control signal generator 210 may not be provided to the first voltage control signal generator 230 when the switch unit 250 is turned off. When the switch unit 250 is turned off, the second control signal generator 220 provides the second control signal CON2 to the first voltage control signal generator 230 which outputs the second control signal CON2 as the first voltage control signal VCON1.

In some example embodiments, a selection signal SEL may be input by the user. For example, when the user may select a power save mode for reducing the power consumption of the display device, the selection signal SEL may be provided to turn on the switch unit 250. Similarly, when the power save mode is not selected, the selection signal SEL that turns off the switch unit 250 may be provided. In other example embodiments, the selection signal SEL may be input according to the operation of the display device. For example, when the display device is operated in the AOD mode, the selection signal SEL that turns on the switch unit 250 may be provided. Further, when the display device is operated in the normal mode, the selection signal SEL that turns off the switch unit 250 may be provided.

Figure 4:
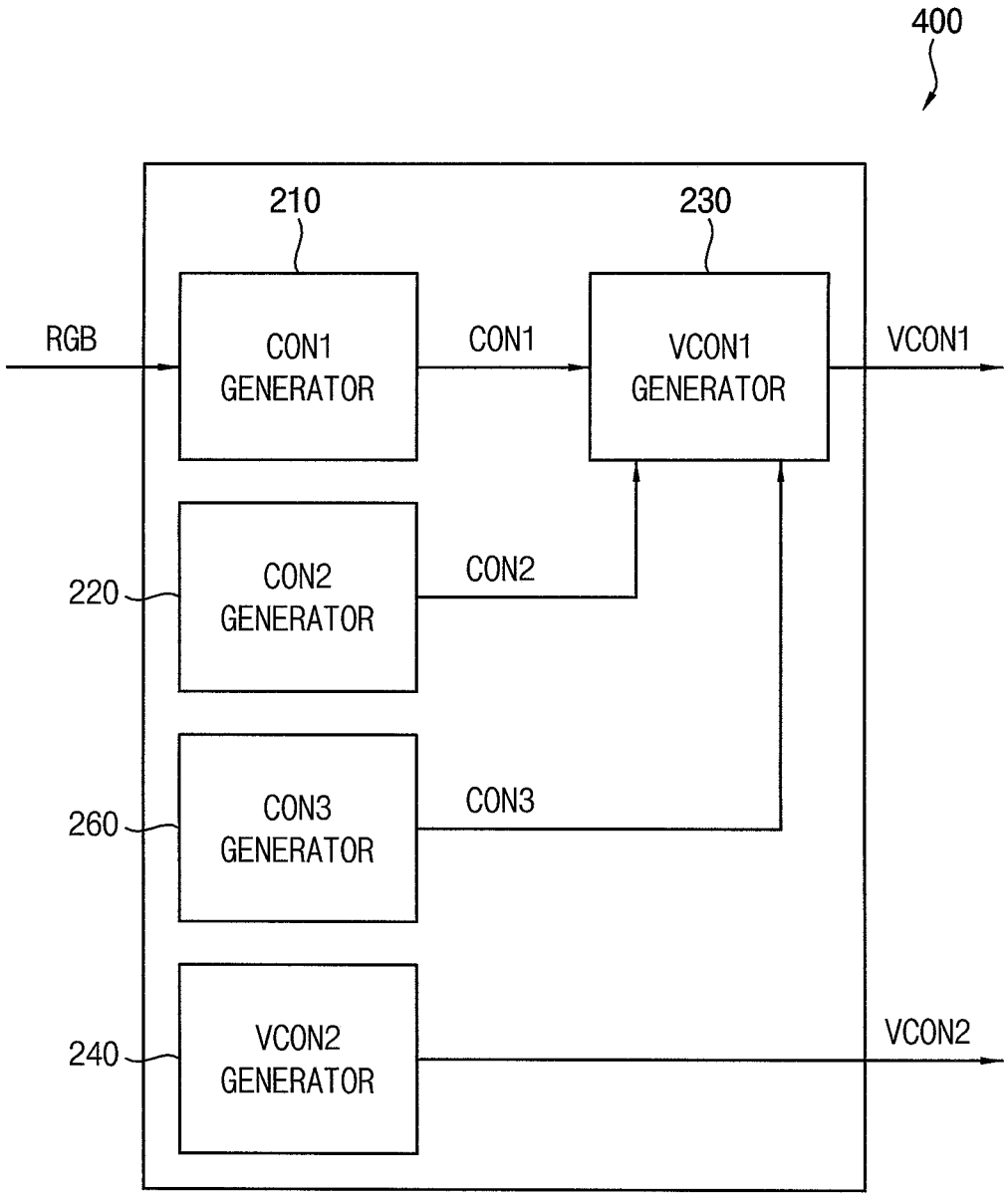
FIG. 4 is a block diagram illustrating other example of a voltage controller included in a driving circuit for a display panel included in the display device of FIG. 1.

FIG. 4 is a block diagram illustrating other example of a voltage controller included in a driving circuit for a display panel included in the display device of FIG. 1.

Referring to FIG. 4, the voltage controller 400 may include the first control signal generator 210, the second control signal generator 220, the first voltage control signal generator 230, the second voltage control signal generator 240, and a third control signal generator 260. The voltage controller 400 of FIG. 4 may be correspond to the voltage controller 144 included in the display panel driving circuit 140 of FIG. 1. The voltage controller 400 may be substantially the same as the voltage controller 144 of FIG. 1 except that includes the third control signal generator 260.

The third control signal generator 260 may calculate the AOR of the image data RGB and generate the third control signal CON3 corresponding to the AOR. The first voltage control signal generator 230 may control the number of pulses in the second control signal CON2 based on the first control signal CON1 and the third control signal CON3. For example, the first voltage control signal generator 230 may increase the pulse number of the second control signal CON2 as the on-pixel ratio of the first control signal CON1 decreases. Further, the first voltage control signal generator 230 may increase the pulse number of the second control signal CON2 as the AOR of the third control signal CON3 is increases. The first voltage control signal generator 230 may output the second control signal CON2 as the first voltage control signal VCON1 which has a number of pulses based on the first control signal CON1 and the third control signal CON3.

Figure 5:
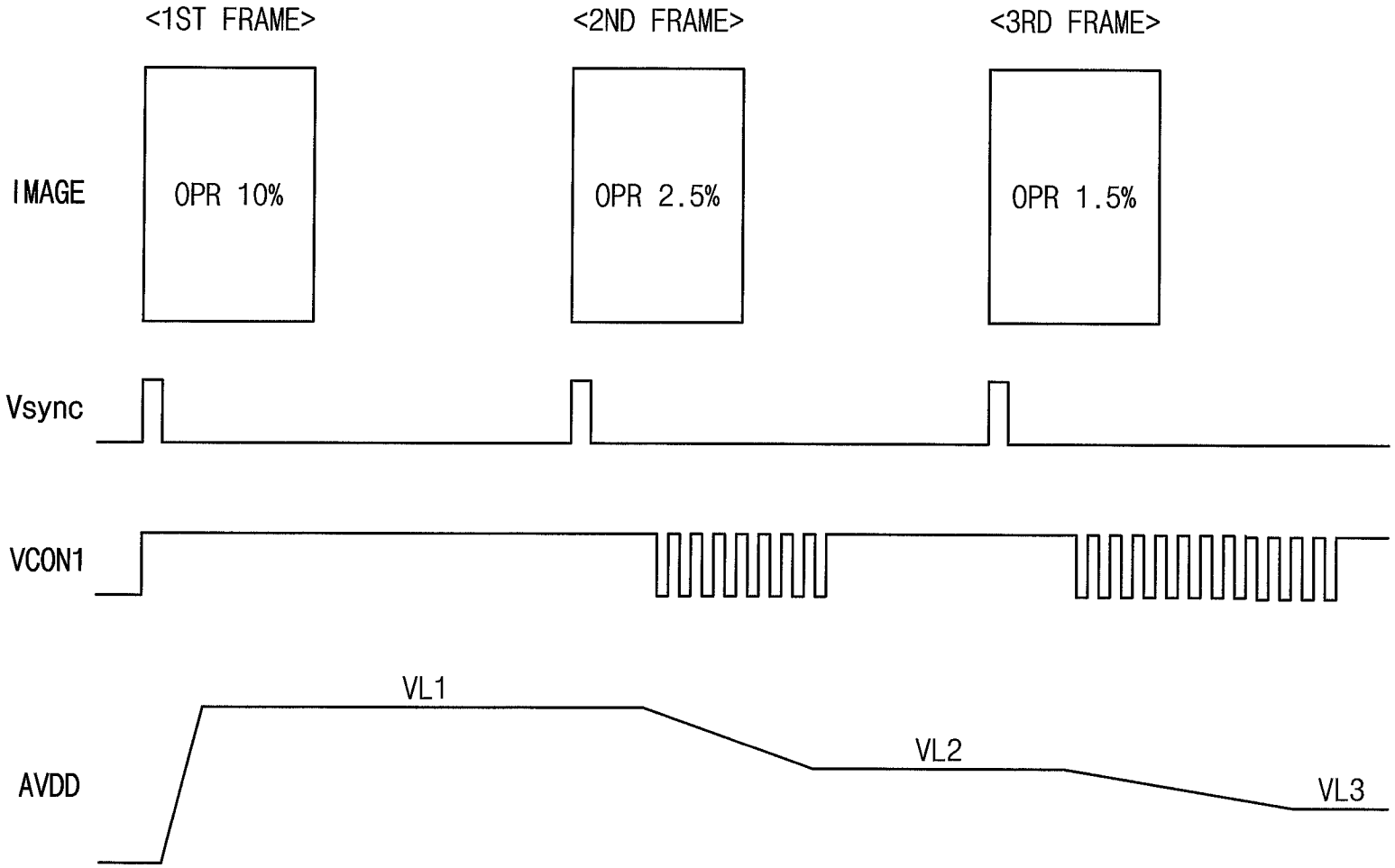
FIG. 5 is a diagram illustrating for describing an operation of a DC-DC convert circuit included in the display device of FIG. 1.

FIG. 5 is a diagram illustrating for describing an operation of a DC-DC conversion circuit included in the display device of FIG. 1.

Referring to FIG. 5, the display panel driving circuit may output the first voltage control signal VCON1 by frames, and the DC-DC conversion circuit may generate the analog supply voltage AVDD corresponding to the first voltage control signal VCON1.

The display panel driving circuit may calculate the on-pixel ratio of the image data input in a first frame 1ST FRAME. When the on-pixel ratio of the image data is above a first threshold (e.g., at 10%) in the first frame 1ST FRAME, the first voltage control signal VCON1 may not include the pulse. The DC-DC conversion circuit may generate the analog supply voltage AVDD having a first voltage level VL1 corresponding to the first voltage control signal VCON1.

The display panel driving circuit may calculate the on-pixel ratio of the image data input in a second frame 2ND FRAME. When the on-pixel ratio of the image data is below a second threshold (e.g., when the on pixel ratio is at 2.5%) in the second frame 2ND FRAME, the number of pulses in the first voltage control signal VCON1 may increase. The DC-DC convert circuit may generate the analog supply voltage AVDD having a second voltage level VL2 corresponding to the first voltage control signal VCON1 (e.g., corresponding to the number of pulses).

The display panel driving circuit may calculate the on-pixel ratio of the image data input in a third frame 3RD FRAME. When the on-pixel ratio of the image data is below a third threshold (e.g., below 1.5%), the number of pulses in the first voltage control signal may increase. The DC-DC convert circuit may in turn generate the analog supply voltage AVDD having a third voltage level VL3 corresponding to the first voltage control signal CON1.

Although the first voltage control signal VCON1 of which the number of pulses increases as the on-pixel ratio of the image data decrease is described in FIG. 5, an operation of the display panel driving circuit is not limited thereto. For example, the number of pulses in the first voltage control signal VCON1 may increase as the on-pixel ratio of the image data increases. Further, the voltage level of the analog supply voltage AVDD decreases as the number of pulses in the first voltage control signal VCON1 increases is described in FIG. 5, an operation of the DC-DC convert circuit is not limited thereto. For example, the DC-DC convert circuit may decrease the voltage level of the analog supply voltage AVDD as the number of pulses in the first voltage control signal VCON1 decreases.

Figure 6:
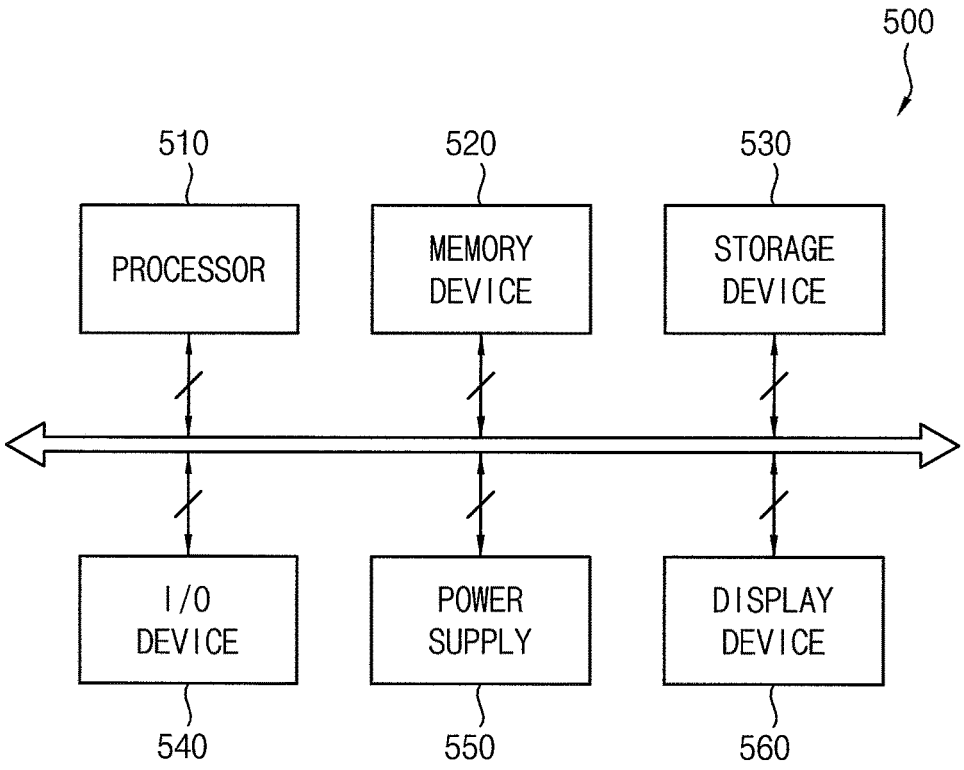
FIG. 6 is a diagram illustrating an electronic device including the display device of FIG. 1.
Figure 7:
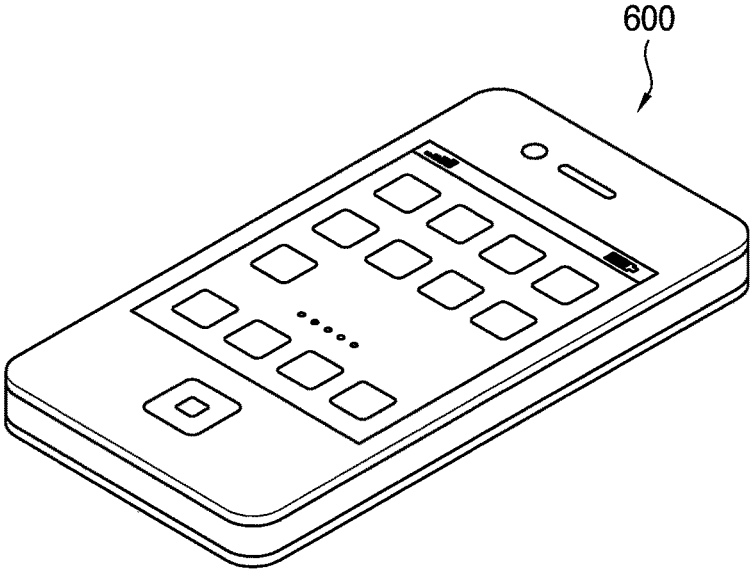
FIG. 7 is a diagram illustrating an example embodiment in which the electronic device of FIG. 6 is implemented as a smart phone.

FIG. 6 is a diagram illustrating an electronic device including the display device of FIG. 1 and FIG. 7 is a diagram illustrating an example embodiment in which the electronic device of FIG. 6 is implemented as a smart phone.

Referring to FIGS. 6 and 7, an electronic device 500 may include a processor 510, a memory device 520, a storage device 530, an input/output (I/O) device 540, a power supply 550, and a display device 560. Here, the display device 560 may correspond to the display device 100 of FIG. 1. In addition, the electronic device 500 may further include a plurality of ports for communicating with a video card, a sound card, a memory card, a universal serial bus (USB) device, other electronic device, etc. Although it is illustrated in FIG. 7 that the electronic device 500 is implemented as a smart phone 600, a kind of the electronic device 500 is not limited thereto.

The processor 510 may perform various computing functions. The processor 510 may be a microprocessor, a central processing unit (CPU), etc. The processor 510 may be coupled to other components via an address bus, a control bus, a data bus, etc. Further, the processor 510 may be coupled to an extended bus such as surrounded component interconnect (PCI) bus. The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 530 may be a solid stage drive (SSD) device, a hard disk drive (HDD) device, a CD-ROM device, etc.

The I/O device 540 may be an input device such as a keyboard, a keypad, a touchpad, a touch-screen, a mouse, etc., and an output device such as a printer, a speaker, etc. In some example embodiments, the display device 560 may be included in the I/O device 540. The power supply 550 may provide a power for operations of the electronic device 500. The display device 560 may communicate with other components via the buses or other communication links. As described above, the display device 560 may include a display panel, a display panel driving circuit, and a DC-DC convert circuit. The display panel may include a plurality of pixels. A plurality of data lines, a plurality of scan lines, a first power voltage providing line, and a second power voltage providing line coupled to the pixels may be formed in the display panel. Each of the pixels may be driven by a first power voltage provided through the first power voltage providing line and a second power voltage provided through the second power voltage providing line. The display panel driving circuit may receive an image data from an external device, output a first voltage control signal for generating an analog supply voltage based on an on-pixel ratio of the image data, and output a second voltage control signal for generating the first power voltage and the second power voltage. The display panel driving circuit may generate gamma voltages based on the analog supply voltage provided from the DC-DC convert circuit and provide the gamma voltages corresponding to the image data to the data lines in the display panel as a data signal. The display panel driving circuit may calculate the on-pixel ratio of the image data and generate a first control signal corresponding to the on-pixel ratio. The display driving circuit may control the pulse number of the second control signal corresponding to the analog supply voltage having a predetermined voltage level based on the first control signal and output the second control signal of which the number of pulses is controlled as the first voltage control signal. For example, the display panel driver may increase the number of pulses in the second signal as the on-pixel ratio of the image data decreases. The display panel driver may calculate an AOR of the image data and generate a third control signal corresponding to the AOR. The display panel driving circuit may control the number of pulses in the second control signal corresponding to the analog supply voltage having the predetermined voltage level based on the first control signal and the second control signal and output the second control signal of which the number of pulses is controlled as the first voltage control signal. For example, the display panel driving circuit may increase the number of pulses of the second control signal as the AOR of the image data increases. Further, the display panel driving circuit may generate the second voltage control signal for generating the first power voltage and the second power voltage. The DC-DC conversion circuit may receive the first voltage control signal and the second voltage control signal output form the display panel driving circuit through a single wire. The DC-DC conversion circuit may generate the analog supply voltage based on the first voltage control signal. For example, the DC-DC conversion circuit may decrease the voltage level of the analog supply voltage as the number of pulses in the first voltage control signal decreases. That is, when the on-pixel ratio of the image data decreases, the pulse number of the first voltage control signal may increase and the voltage level of the analog supply voltage as the number of pulses in the first voltage control signal increases. Thus, the power consumption of the display device 560 may decrease as the on-pixel ratio of the image data decreases because the voltage level of the analog supply voltage decreases as the on-pixel ratio of the image data decreases. The DC-DC conversion circuit may generate the first power voltage and the second power voltage based on the second voltage control signal.

As described above, the electronic device 500 of FIG. 6 may include the display device 560 that controls the voltage level of the analog supply voltage based on the on-pixel ratio of the image data. The display device may control the voltage level of the analog supply voltage generated in the DC-DC convert circuit by calculating the on-pixel ratio of the image data and controlling the pulse number of the first voltage control signal provided to the DC-DC convert circuit based on the on-pixel ratio. Thus, the power consumption of the electronic device 500 that includes the display device 560 may decrease.

Figure 8:
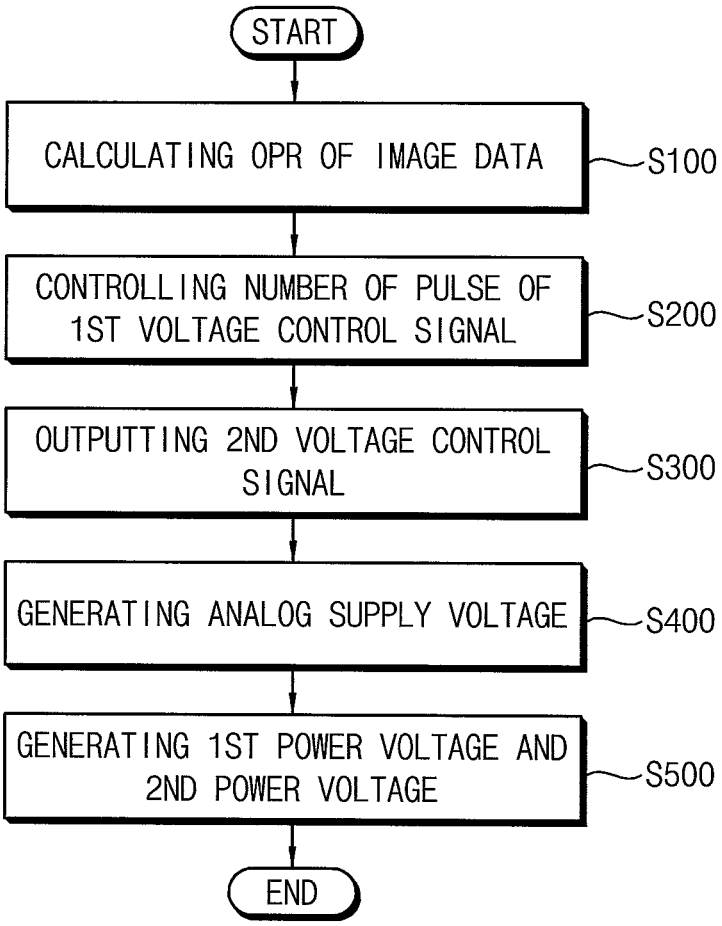
FIG. 8 is a flowchart illustrating a driving method of a display device according to example embodiments.

FIG. 8 is a flowchart illustrating a driving method of a display device according to example embodiments.

Referring to FIG. 8, a driving method of a display device may include an operation of calculating an on-pixel ratio of the image data, an operation of controlling the number of pulses in the first voltage control signal for generating the analog supply voltage based on the on-pixel ratio, an operation of outputting a second voltage control signal for generating a first power voltage and a second power voltage, an operation of generating an analog supply voltage based on the first voltage control signal, and an operation of generating the first power voltage and the second power voltage.

The driving method of the display device may calculate the on-pixel ratio of the image data (S100). The display device may receive the image data provided from an external device and calculate the on-pixel ratio by frames.

The driving method of the display device may control the number of pulses in the first voltage control signal for generating the analog supply voltage based on the on-pixel ratio. The first voltage control signal may be generated based on the first control signal corresponding to the on-pixel ratio of the image data and the second control signal corresponding to the analog supply voltage having the predetermined voltage level (S200). For example, the analog supply voltage may have a first voltage level in the normal mode and may have a second voltage level lower than the first voltage level in the AOD mode. The number of pulses in the second control signal may be controlled (e.g., modified) based on the first control signal and the second control signal may be output as the first voltage control signal. For example, the pulse number of the second control signal may increase when the on-pixel ratio decreases and the second control signal of which the pulse number is increased may be output as the first voltage control signal.

The operation of generating the first voltage control signal may further include an operation of calculating AOR of the image data and generating a third control signal corresponding to the AOR. Here, the first voltage control signal may be generated based on the first control signal, the second control signal and the third control signal. The number of pulses in the second control signal may be modified according to the first control signal and the third control signal and the modified second control signal may output as the first voltage control signal. For example, the pulse number of the second control signal may increase when the on-pixel ratio decreases and the pulse number of the second control signal may increases when the AOR increases.

The driving method of the display device may output the second voltage control signal for generating the first power voltage and the second power voltage (S300). The first power voltage and the second power voltage are voltages that drive the pixels.

The driving method of the display device may generate an analog supply voltage based on the first voltage control signal (S400). The voltage level of the analog supply voltage may be controlled based on the pulse number of the first voltage control signal. For example, the voltage level of the analog supply voltage may decrease as the pulse number of the first voltage control signal increases.

The driving method of the display device may generate the first power voltage and the second power voltage based on the second voltage control signal (S500).

As described above, the driving method of the display device may decrease the power consumption of the display device by calculating the on-pixel ratio of the image data and controlling the voltage level of the analog supply voltage based on the on-pixel ratio.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A display device comprising:

a display panel comprising a plurality of pixels driven by a first power voltage and a second power voltage;

a display panel driving circuit configured to receive image data from an external device, to output a first voltage control signal for generating an analog supply voltage based on an on-pixel ratio (OPR) of the image data, to generate gamma voltages based on the analog supply voltage, and to output a second voltage control signal for generating the first power voltage and the second power voltage; and a DC-DC conversion circuit configured to generate the analog supply voltage based on the first voltage control signal and generate the first power voltage and the second power voltage based on the second voltage control signal, wherein the display panel driving circuit is configured to control a number of pulses in the first voltage control signal according to the on-pixel ratio, and wherein the DC-DC conversion circuit is configured to change a voltage level of the analog supply voltage based on a change in the on-pixel ratio that corresponds to the number of pulses in the first voltage control signal, such that a power consumption of the display device decreases based on a decrease in the on-pixel ratio.

2. The display device of claim 1, wherein the display panel driving circuit comprises:

a data processor configured to generate a data signal corresponding to the image data based on the analog supply voltage; and a voltage controller configured to generate the first voltage control signal and the second voltage control signal.

3. The display device of claim 2, wherein the voltage controller comprises:

a first control signal generator configured to calculate the on-pixel ratio of the image data and generate a first control signal corresponding to the on-pixel ratio;

a second control signal generator configured to output a second control signal corresponding to the analog supply voltage having a predetermined voltage level;

a first voltage control signal generator configured to generate the first voltage control signal based on the first control signal and the second control signal; and a second voltage control signal generator configured to generate the second voltage control signal.

4. The display device of claim 3, wherein the voltage controller further comprises:

a switch unit formed between the first control signal generator and the first voltage control signal generator, wherein the first voltage control signal generator generates the first voltage control signal based on the first control signal and the second control signal when the switch unit is turned on, and wherein the first voltage control signal generator outputs the second control signal as the first voltage control signal when the switch unit is turned off.

5. The display device of claim 3, wherein the first voltage control signal generator controls a number of pulses in the second control signal based on the first control signal and outputs the second control signal of which the number of pulses is controlled as the first voltage control signal.

6. The display device of claim 3, wherein the voltage controller further comprises:

a third control signal generator configured to calculate an AMOLED off ratio (AOR) of the image data and generate a third control signal corresponding to the AMOLED off ratio.

7. The display device of claim 6, wherein the first control signal generator generates the first voltage control signal based on the first control signal, the second control signal, and the third control signal.

8. The display device of claim 1, wherein a voltage level of the analog supply voltage decreases as the on-pixel ratio decreases.

9. The display device of claim 1, wherein the display device is configured to change a voltage level of the analog supply voltage in a standby mode in which a standby image is always displayed on the display panel.

10. The display device of claim 1, wherein the display device is configured to change a voltage level of the analog supply voltage in a normal mode in which an image is displayed on the display panel.

11. The display device of claim 1, wherein the DC-DC conversion circuit comprises:

an analog supply voltage generator configured to generate the analog supply voltage provided to the display panel driving circuit based on the first voltage control signal; and a power voltage generator configured to generate the first power voltage and the second power voltage based on the second voltage control signal.

12. The display device of claim 11, wherein the analog supply voltage generator is configured to generate the analog supply voltage based on the number of pulses in the first voltage control signal.

13. A driving method of a display device, the method comprising:

receiving image data from an external device and calculating an on-pixel ratio (OPR) of the image data;

controlling a number of pulses in a first voltage control signal for generating an analog supply voltage based on the on-pixel ratio;

outputting a second voltage control signal for generating a first power voltage and a second power voltage;

generating the analog supply voltage based on the first voltage control signal;

generating gamma voltages based on the analog supply voltage;

changing a voltage level of the analog supply voltage based on a change in the on-pixel ratio, such that a power consumption of the display device decreases based on a decrease in the on-pixel ratio; and generating the first power voltage and the second power voltage based on the second voltage control signal.

14. The driving method of claim 13, wherein the first voltage control signal is generated based on a first control signal corresponding to the on-pixel ratio of the image data and a second control signal corresponding to the analog supply voltage having a predetermined voltage level.

15. The driving method of claim 14, wherein a number of pulses in the second control signal is controlled based on the first control signal, and wherein the second control signal is output as the first voltage control signal.

16. The driving method of claim 14, wherein generating the first voltage control signal further comprises:

generating a third control signal corresponding to an AMOLED off ratio (AOR) of the image data.

17. The driving method of claim 16, wherein the first voltage control signal is generated based on the first control signal, the second control signal, and the third control signal.

18. The driving method of claim 16, wherein a number of pulses in the second control signal is controlled based on the first control signal and the third control signal, and wherein the second control signal is output as the first voltage control signal.

19. The driving method of claim 13, wherein a voltage level of the analog supply voltage decreases as the on-pixel ratio decreases.

20. The driving method of claim 13, wherein a voltage level of the analog supply voltage is controlled based on the number of pulses in the first voltage control signal.

* * * * *